US007467911B2

(12) United States Patent
Flury

(10) Patent No.: US 7,467,911 B2
(45) Date of Patent: Dec. 23, 2008

(54) STORM DRAIN BASIN GATE SYSTEM

(76) Inventor: Ronald J. Flury, 19500 Normandie Ave., Torrance, CA (US) 90502

( * ) Notice: Subject to any disclaimer, the term of this patent is extended or adjusted under 35 U.S.C. 154(b) by 0 days.

(21) Appl. No.: 11/821,623

(22) Filed: Jun. 25, 2007

(65) Prior Publication Data

US 2008/0014021 A1 Jan. 17, 2008

Related U.S. Application Data

(63) Continuation-in-part of application No. 11/335,591, filed on Jan. 20, 2006, now Pat. No. 7,234,894.

(51) Int. Cl.
*E03F 5/06* (2006.01)

(52) U.S. Cl. ..... 405/94; 405/95; 405/100; 210/170.03

(58) Field of Classification Search ..... 405/94, 405/99, 100
See application file for complete search history.

(56) References Cited

U.S. PATENT DOCUMENTS 6,390,730 B1 * 5/2002 Scheibe ..... 405/100
6,478,954 B1 * 11/2002 Turner et al. ..... 210/162
6,623,209 B1 * 9/2003 Waters, Jr. ..... 405/94
7,083,359 B2 * 8/2006 Aughton et al. ..... 405/100
2004/0009041 A1 * 1/2004 Aughton et al. ..... 405/99
2004/0069697 A1 * 4/2004 Martinez ..... 210/163
2006/0083592 A1 * 4/2006 Aughton et al. ..... 405/100

* cited by examiner

*Primary Examiner*—Tara L. Mayo
(74) *Attorney, Agent, or Firm*—Orrick Herrington & Sutcliffe LLP

(57) ABSTRACT

A gate system for an opening through which fluid flows, such as the opening to a storm drain typically found in the curb of an urban street. The system is biased to a closed condition to keep trash out of the drain during dry and low fluid flow situations, then automatically converts to an open condition during heavy fluid flow situations, and then returns to a closed condition when the heavy fluid flow condition abates. The system has a gate portion that rotates between an open position and a closed position adjacent the opening, being biased to the closed position, and a trip plate, which is also biased to a closed position. The trip plate has one or more pins that communicate with one or more grooves and/or detents in one or more adjacent bracket assemblies to hold the gate portion in the closed position until the fluid flow on or against the trip plate reaches a predetermined level such that the trip plate rotates from the closed position, releasing the gate portion and allowing the fluid flow to push the gate portion into an open position. After the fluid flow abates, both the gate portion and the trip plate rotate back to their closed positions automatically.

24 Claims, 5 Drawing Sheets

FIG. 1
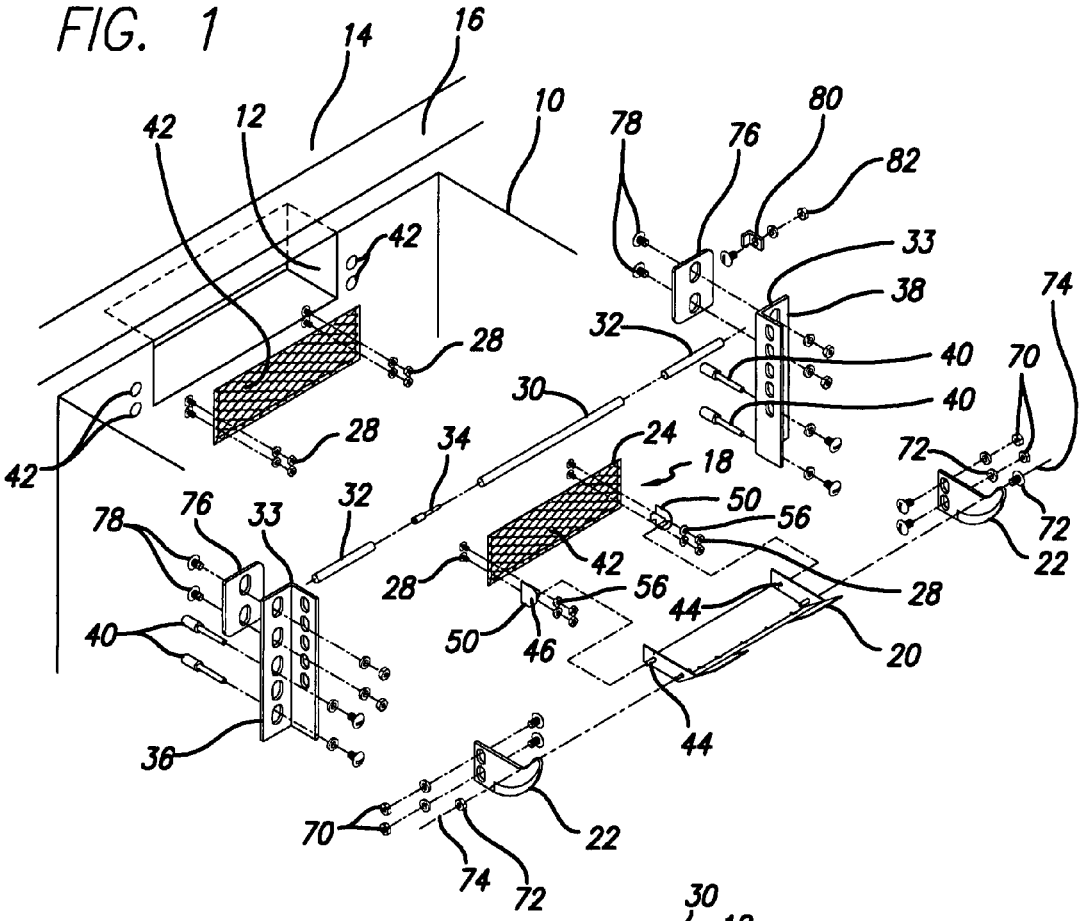
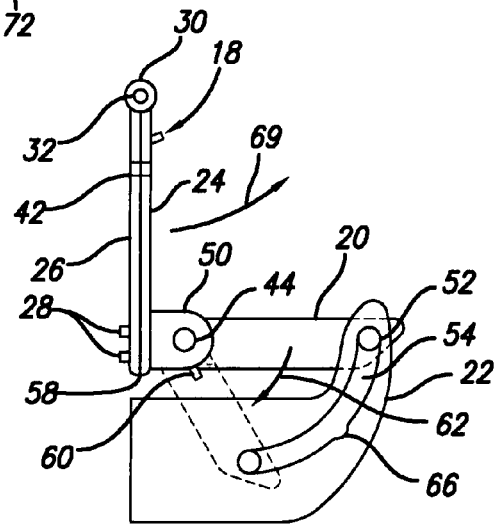
FIG. 2

STORM DRAIN BASIN GATE SYSTEM

CROSS REFERENCE TO RELATED APPLICATIONS

This application is a continuation-in-part of U.S. Ser. No. 11/335,591, filed Jan. 20, 2006 entitled Storm Drain Basin Gate System, now U.S. Pat. No. 7,234,894, issued Jun. 26, 2007.

BACKGROUND OF THE INVENTION

This invention relates generally to a gate system for use with a storm drain of the type typically found in the curb of a street. More particularly, this invention relates to such a system which during periods of low water flow is in a closed position to effectively prevent debris from entering into the storm drain, but which during periods of high water flow opens to allow the maximum amount of water to enter into the drain to alleviate the accumulation of water in the street and the surrounding areas.

What to do with excess runoff rain water has been an issue for urban planners and dwellers for a long time. Even in arid regions, the occasional heavy rainfall will create large volumes of run off that must be channeled effectively or flooding resulting in impassable roads at least or the loss of property and lives at worst may occur. In areas of high annual rainfall, effectively channeling that rainwater away from streets and homes is an absolute must.

For this reason, almost every city in the civilized world has an extensive underground storm drain system. And the most common inlet to the entire system is the ubiquitous curbside opening that is built into the sidewalk curb along the street. Those openings typically lead to a rather large underground chamber, often called a vault, at one end of which there is a conduit that leads to the main storm drain pipe that is usually set under the paved road adjacent the vault.

These drain systems have proven very effective in channeling runoff storm water away from the streets and populated areas, and usually into an adjacent river or into the ocean. However, another ubiquitous part of urban life—street debris and litter—also finds its way into the storm drain system. For example, some cigarette smokers seem to believe that their cigarette butts are not litter to be deposited in a trash can, but something that can be thrown on the ground wherever they happen to be when they must discard the cigarette—thrown into the gutter as they walk along the sidewalk, or thrown out of the car as they drive along. These cigarette butts, which are not environmentally friendly and do not naturally degrade easily, invariably end up in the drain system and then into the river or ocean into which it drains. Other trash, from paper cups to hamburger wrappers to envelops, all find their way into the gutters. drain systems and ultimately river and ocean. And this is just the man-made debris. Natural debris such as leaves and twigs are also commonly found in streets and gutters. and then make their way into the storm drain system when it rains, or when water from some other source makes its way into the street.

It is not just the introduction of these items into the drain system that is a problem. Most storm drain systems ultimately empty directly into a nearly body of water, often a river or the ocean. Also, the systems rarely include any type of intermediate water treatment facility, so what goes into the drain system usually ends up in river, lake or ocean, where it is unsightly and can be toxic.

Because the introduction of trash and other debris into the storm drain system is such a common occurrence, many street side drains are constructed with a sizeable open chamber into which the storm drain opening leads, with the conduit to the under-street pipe located at one end thereof. The purpose of this is to try to trap as much of the debris as possible in the vault, and only allow the water to run-off into the system. This has proven only partially effective. First, so much trash is often introduced into the vault that much of it gets into the system anyway. This is particularly true if there is an accumulation of trash in the vault when there is a heavy rainfall or other heavy flow of water into the vault. Second, this arrangement necessarily requires that the vault be periodically cleaned, and cleaning the vault cannot of course be done by the usual street sweeping equipment, but requires an entirely different piece of equipment with strong suction capability to literally vacuum the trash from the vault. Third, this arrangement is designed to allow the trash to accumulate in the vault in between cleanings, such that in a worst case scenario, the accumulated trash becomes so large that the drain becomes plugged wholly or partially, and flooding in the area occurs when it rains.

In light of these issues, various attempts have been made to prevent trash from getting into drain. For example, in some places, a sizeable plate has been securely attached over the drain opening, leaving only a little space for water to flow. This solution does prevent much of the trash from entering into the drain, but it also prevents much of the water as well, and essentially defeats the purpose of the large drain opening that was intended to prevent flooding during heavy water run off. Therefore, other attempts have been made to design a storm drain gate that would remain closed during periods of low water run off, but which would automatically open in periods of heavy water run off. One recent example is U.S. Pat. No. 6,972,088, to Yehuda, in which a Pivotal Gate For A Catch Basin Of A Storm Drain System is disclosed. That invention uses a rather complex system involving a rotatable paddle wheel and interconnected wires that interplay to open the gate when sufficient water begins to flow into the drain. While it appears workable, this system may not be desirable for widespread installation given its complexity, which translates into higher initial cost and higher cost of upkeep. It is a given in any piece of machinery that the more moving and complex the component parts, the more costly to manufacture and install, and the more costly to maintain, and more likely to malfunction. Other prior art devices suffer from one or more of these drawbacks. as the design goals of simplicity, ease of installation, durability, low maintenance, and high effectiveness are difficult to achieve.

Therefore, there exists a need in the art for such a simple, effective gate system.

SUMMARY OF THE INVENTION

The preferred embodiments of the invention herein depicted and described provides such a device wherein the gate portion of the system that prevents trash from entering into the vault or drain basin is kept in the closed position by virtue of a trip plate that is rotatably attached to the back of the gate portion. In one preferred embodiment of the invention, the trip plate is attached to the back lower portion of the gate portion, and is biased (in one preferred embodiment by a spring) to closed position that is, substantially perpendicular to and extending rearwardly from the gate portion in one preferred embodiment. The trip plate is prevented from moving backward (that is, away from the gate), which in one preferred embodiment is accomplished by two pins extending from the plate into a groove formed in each of a pair of bracket assemblies that are attached to the drain basin wall. Thus, when there is no-flow or low-flow of water through the gate portion onto or against the trip plate, the plate stays in position and in turn keeps the gate portion in a closed position, flush against the drain basin opening. When the flow of water increases to a predetermined point, however, the water weight on the trip plate increases to the point where the biasing is overcome, and the trip plate rotates into an open position. This releases the gate portion and allows it to open. When the water flow onto the trip plate stops or reduces to a sufficiently low flow, the water weight on the trip plate is no longer sufficient to overcome the biasing on the plate, and it rotates back into its closed position, which in turn causes the gate portion to rotate downward into its "closed" position against the drain basin opening. Also disclosed and claimed are improved and alternative apparatus for attaching the system to the storm drain basin, and for controlling the location of the trip plate.

The preferred embodiments of this invention will now be depicted and described. As will be apparent to those skilled in the art, however, there are many different ways of attaching the various components of this system to the basin, and to one another, and of creating the biasing of the trip plate, and there are too many different ways to do so to list and describe here. Such common variants, even if not specifically described, are nonetheless considered to be within the scope of this invention.

DESCRIPTION OF THE FIGURES

FIG. 1 is an exploded, perspective view of one embodiment of this invention.

FIG. 2 is a partial side view of the preferred embodiment of this invention, showing the interplay between the gate, the trip plate and the guide brackets.

DESCRIPTION OF THE PREFERRED EMBODIMENTS

Figure 3:
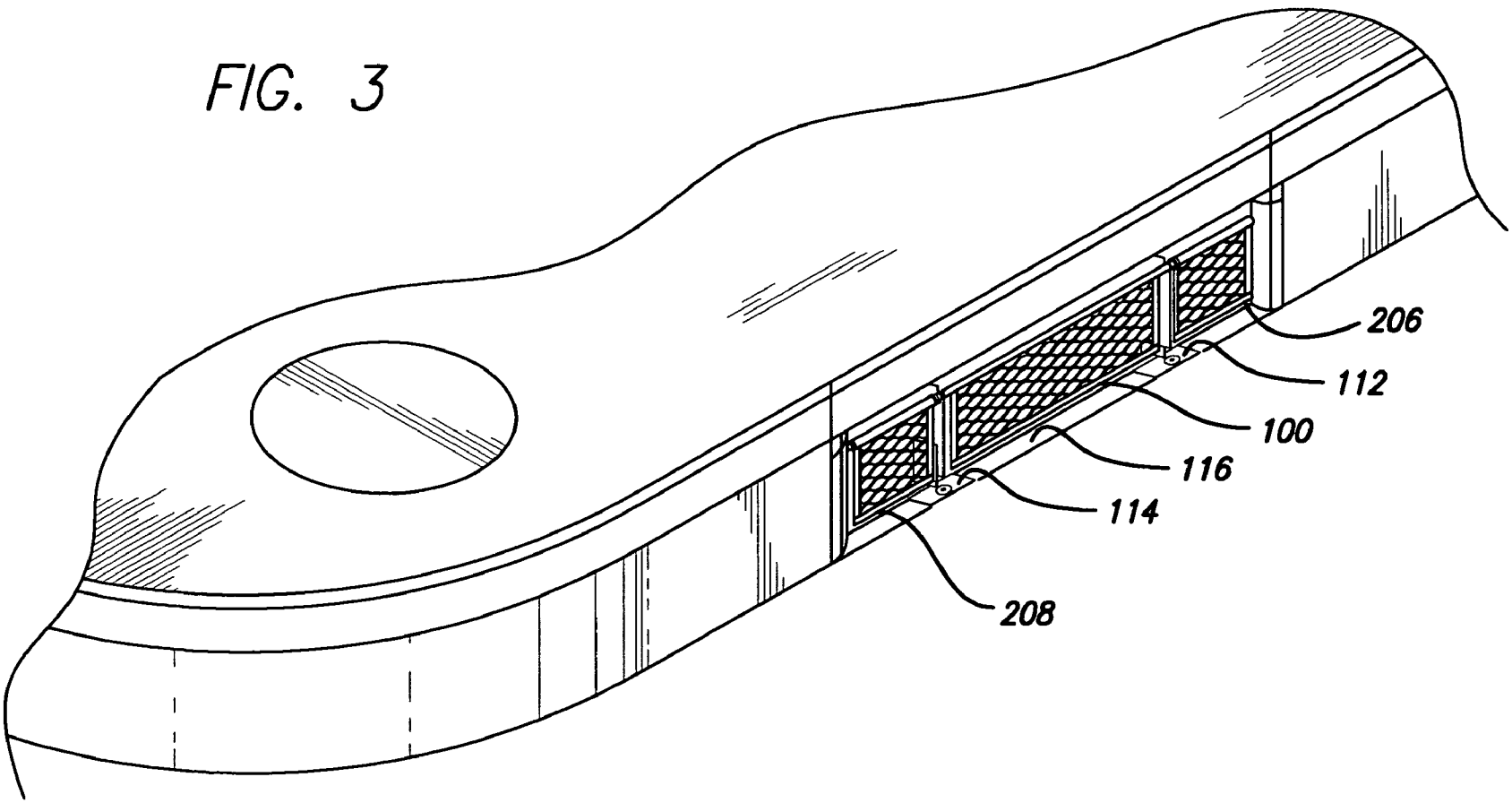
FIG. 3 is a perspective view showing one of the preferred embodiments of the gate system in its closed position within the opening of a curb drain basin.

Looking at FIG. 1, it is seen that this preferred embodiment of the invention is for attachment to the inside of a curb-side storm drain basin 10, adjacent to and providing a cover for the opening 12 that leads from the basin 10 to the street 14 through the curb 16. It should be noted, however, that while the device of this invention is believed to find primary utility in this application, and is why the title of this invention includes a reference to a storm drain, the invention herein described and claimed is a gate system that is not limited to that one application. The device of this invention could be usefully applied to any situation where it is desired to screen particulate matter from a fluid flow through an aperture during no-flow and low-flow conditions, but to remove the screen from the aperture during high-flow conditions.

The overall system consists primarily of a gate assembly 18, the biased trip plate 20, trip plate brackets 22, and the various means by which these components are attached to one another, and to the side of the basin 10. All components of this system are preferably constructed of 304 stainless steel. Other materials, however, could be used so long as they exhibited the required strength and durability appropriate for the application in which the system is used.

Although FIG. 1 shows in an exploded, perspective view how all of the various components are connected, the interplay of the gate assembly 18, the biased trip plate 20 and the trip plate bracket assemblies 22 can best be seen in FIG. 2. The gate assembly 18 comprises in this embodiment a gate portion constructed of a pair of gate plates 24 and 26 that are held together by any conventional means, in this instance by nuts and bolts 28. Of course, there are a myriad of other ways to attach the two gate plates together, such as welding, gluing, screws, rivets, brackets, etc. Also, the gate portion of assembly 18 does not have to be constructed of multiple plates, and could be of unitary construction, or could be of many individual plates.

In this embodiment, the gate plate assembly 18 is rotatably attached to the basin 10 by means of a hollow tube 30 that is attached to the top of the gate assembly 18, a pair of side pins 32 that are slidably housed within either end of the tube 30 and which are biased outwardly of the tube 30 by means of a spring 34 that is also housed within the tube 30 and forces the pins 32 outwardly. The distal end of the pins 32 engage appropriately-sized holes 33 in the large side brackets 36 and 38 (seen in FIG. 1, not shown in FIG. 2), which are in turn attached to the side of the basin 10 by conventional means—in this instance, by bolts 40 that are set into appropriated-sized holes 42 the side wall of the basin 10 on either side of the opening 10. As will be appreciated, this arrangement allows for easy attachment and free rotatability of the gate assembly 18 to the large side brackets 36 and 38, as one of the pins 32 can be placed into one of the holes 33, and then the other pin 32 can be pushed inwardly, the tube 30 brought into alignment with the other hole 33, and that pin 32 then allowed to extend into that hole 33 so that the entire gate assembly 18 is now firmly yet rotatably attached into position against the opening 12. As will be apparent, the attachment inter-relationship between these components can be adjusted to ensure that the gate 18 is properly positioned flushly against the opening 12.

To provide the desired screening function, the gate plates 24 and 26 have a number of holes 42 extending therethrough. These holes can be of any desired shape, size, configuration and distribution as desired under the circumstances. For example and not in way of limitation, commercial mesh screens could be used under the appropriate circumstances.

Referring now back to FIG. 2, it will be seen that the trip plate 20 is rotatably attached to the lower end of the gate assembly 18. Here, the attachment means provided are a pair of pins 44 attached to the side of the trip plate 20 and which communicate with appropriately sized holes 46 in small brackets 50 that are attached to the gate assembly 18 via the same nuts and bolts 28 that are used to attached gates plates 24 and 26 together. It will be appreciated, however, that the manner in which the trip plate 20 is attached to the gate assembly 18 is not limited to the means showed, and can be accomplished by any other conventional method and means whereby the trip plate 20 is securely but rotatably attached such that the trip plate 20 can rotate from a first or closed position to a second or open position.

Again looking at FIG. 2, the interaction between gate assembly 18, the trip plate 20 and the side bracket assemblies 22 can best be appreciated. At the distal end of the trip plate 20, a pair of outwardly extending pins 52 communicate with an arcuate groove 54 formed in each of the bracket assemblies 22. In a no-flow or low-flow situation in which no or very little water is entering into the storm drain through the gate assembly 18, the trip plate 20 is biased upwardly so that the pins 52 are pressed against the top of the grooves 54. In this embodiment, the biasing of the trip plate 20 upwardly is accomplished by a pair of torsion springs 56 (seen only in FIG. 1). One end of the torsion springs resides in hole 58 in the side bracket 50 and the other end of the torsion spring resides in the hole 60 in the trip plate 20. Again, this is only one of many ways in which the trip plate 20 can be biased into its closed position, and this invention is not limited to the one method and means shown.

In this preferred embodiment, the side bracket assemblies 22, the grooves 54 and the side pins 52 are all arranged such that in that position, the trip plate 20 extends in a horizontal fashion directly behind and perpendicular to the gate portion (that is, gate plates 24 and 26) on the gate assembly 18. Thus, in this position, the interplay between pins 52 within the bracket grooves 54, and the bracket assemblies 22 (which are attached to the side wall of the basin 10) has the effect of holding the gate plates 24 and 26 in a vertical, closed position, flushly against the opening 12 in the drain basin 10.

In this preferred embodiment, the trip plate 20 will hold the gate portion of gate assembly 18 in that position for so long as the water flowing through the basin opening 12 and onto the trip plate 20 is sufficiently small that the weight of the water bearing down on trip plate 20 is insufficient to overcome the upward biasing on the trip plate 20 caused by the torsion springs 56. As the flow of water increases, however, and the resultant force of the water acting on trip plate 20 increases, the upward biasing is overcome, and the trip plate 20 begins to rotate in a downward direction, shown by arrow 62. As this occurs, the trip plate 20 moves out of its horizontal, perpendicular alignment relative to the gate portion of gate assembly 18, which in turn allows the gate portion of gate assembly 18 to begin to rotate in an upward direction as shown by arrow 694, effectively enlarging the open space to allow more water to flow into the basin. It will also be noted that as the trip plate 20 rotates downwardly, the side pins 52 travel downwardly within the grooves 54. In one embodiment of this invention, the grooves 54 are provided with one or more detents 66 (only one of which is shown in FIG. 2) which act as intermediate stopping points during the downward movement of the trip plate 20. In other words, as the water flow onto the trip plate 20 increases and its starts to rotate downward, it will encounter one of the detents 66. The pins 52 are forced into the detent, and will tend to reside there until the water weight increases incrementally until the pins 52 are forced out of the detents 66. This will allow for staged opening of the gate assembly 18, and will also work to prevent fluttering of the gate assembly as the water flow ebbs and increases. It will be appreciated that the size and depth of the detents 66 must be controlled so as to not unduly hinder the movement of the trip plate in either the downward or upward direction.

As the water weight continues to increase, eventually the biasing and the detents are overcome, and the trip plate 20 will rotate entirely downward (as shown in shadow in FIG. 2). At this point, the trip plate 20 ceases to exercise any limiting function on the gate assembly 18, which in turn is allowed to rotate entirely open. By appropriate sizing and placement of the brackets 50, the side pins 44 and the other components, the gate assembly 18 can be allowed to rotate through a full 90 degrees such that it comes to rest against the ceiling of the drain basis, in which case the storm drain opening 12 is complete unobstructed, maximum flow of water into the basis is allowed, and even trip plate 20 is pulled up substantially away from the water flow.

In this preferred embodiment, once the water flow recedes, the biasing on the trip plate 20 will again be greater than the water force acting on the trip plate, and it will again rotate into its closed position, simultaneously forcing the gate portion of gate assembly 18 downward and into its closed position flush against the basin opening 12.

Referring back to FIG. 1, it will been seen that the trip plate bracket assemblies 22 are attached to the large side brackets 36 and 38 by nut and bolts 70 to provide added stability to the interplay between the trip plate pins 52 and the grooves 54, the ends of the pins 52 can be fitted with washers 72 and screws 74 to ensure that the pins 52 remain within the grooves 54 at all times, even if the trip plate 20 happens to be subjected to an uneven, torquing force that might otherwise cause the pins to become dislodged from the grooves. Lastly, the overall system can include side plates 76 that are attached to the large side brackets 36 and 38 by conventional nut and bolts 78 and a simple flanged element 80 that is attached to the side bracket 38 by conventional nut and bolt 82, and which acts as a "stop" to prevent the gate assembly 18 from being pulled open in the direction of the street.

Figure 4:
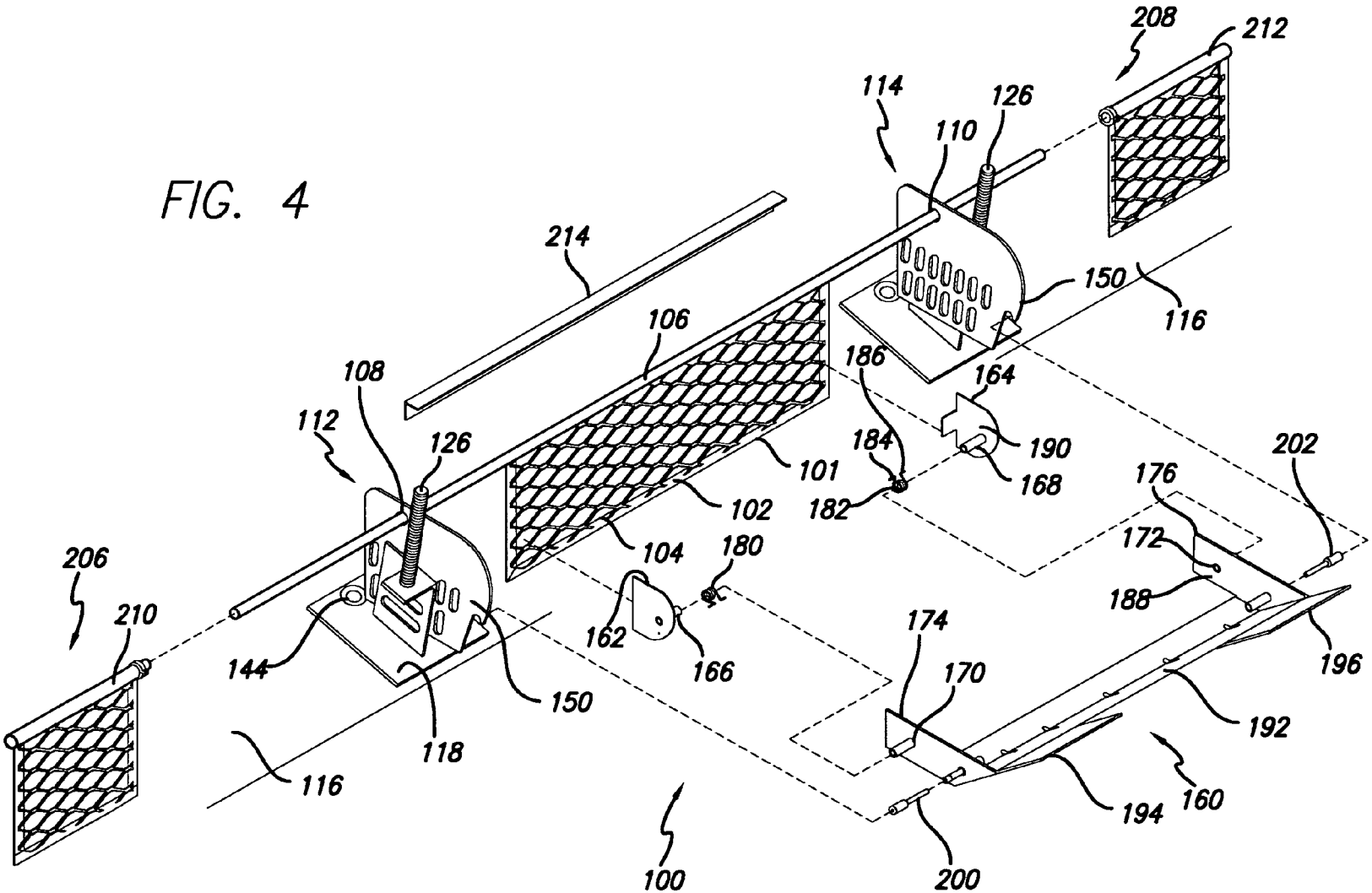
FIG. 4 is a perspective, exploded view, showing the component pieces of an alternative embodiment of this invention.

Referring now to FIG. 4, an other alternative embodiment is shown. This embodiment can be utilized in a wide variety of drain basins where the curb-side openings are of different width. In this embodiment there is a gate assembly 100 that has a gate portion 101 that comprises a frame 102 to which is attached a mesh material 104. In this instance, the mesh material 104 is a section of metal grate commercially available that has apertures of the desired size and shape depending on the particulate matter to be kept from entering the basin when the gate portion 101 is in the closed position (as is shown in the FIGS.). The mesh material 104 is attached to the frame 102 by any conventional means, such as by welding. The upper portion of the frame 102 is attached to rod 106. As shown here, the frame 102 is welded to circular rod 106, but any other attachment means could be utilized so long as the attachment is secure, fixed and durable.

The rod 106 extends through a pair of appropriately sized apertures 108 and 110, respectively, in bracket assemblies 112 and 114. The size of apertures 108 and 110 should be only slightly larger than the diameter of rod 106 so that rod 106 can rotate, and slide side-to-side within the apertures, but is otherwise held generally in place. The overall length of rod 106 will be dictated by the overall width of the basin opening to be covered.

Figure 5:
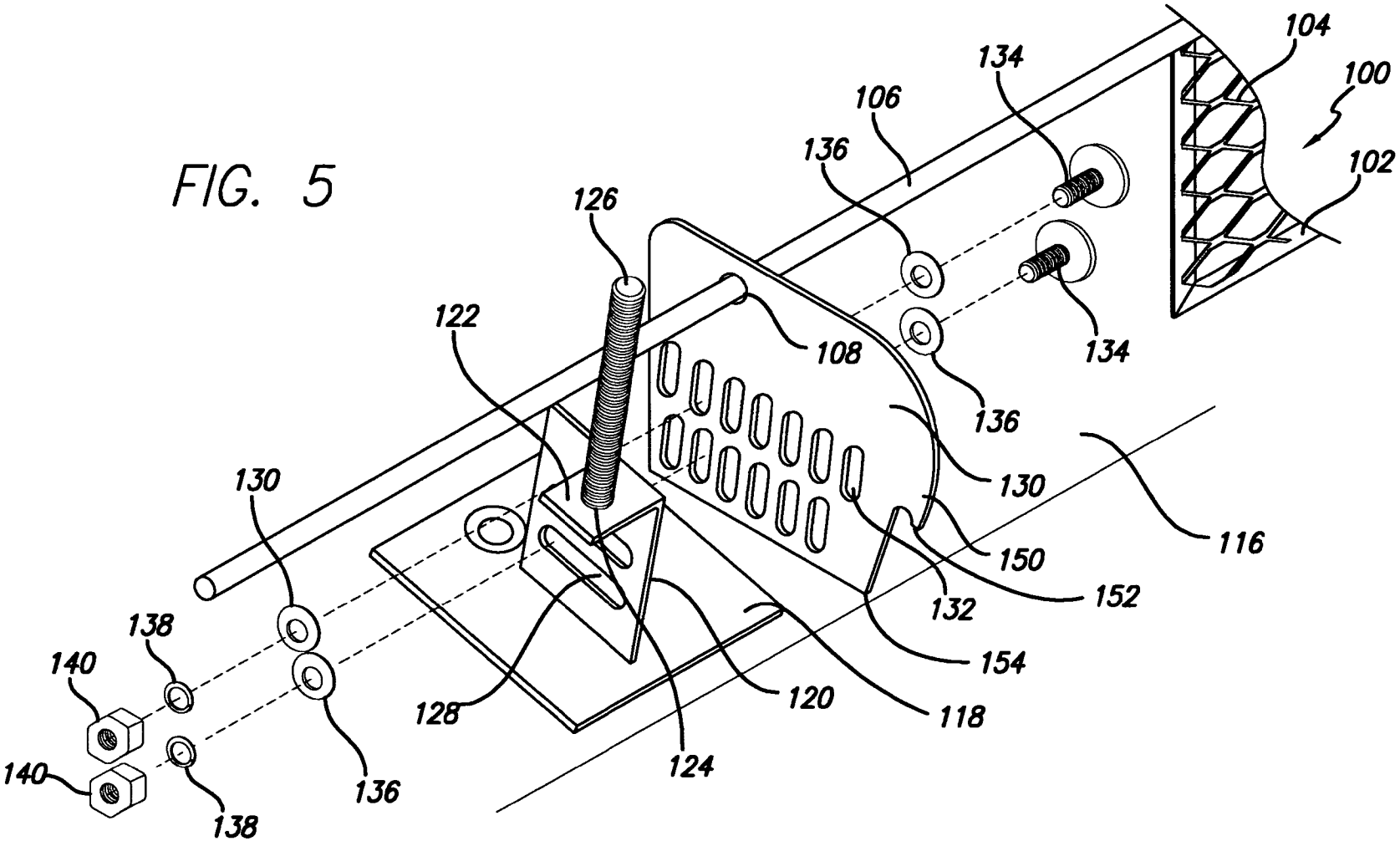
FIG. 5 is a perspective, exploded view, showing in isolation one side of one embodiment of the invention.
Figure 6:
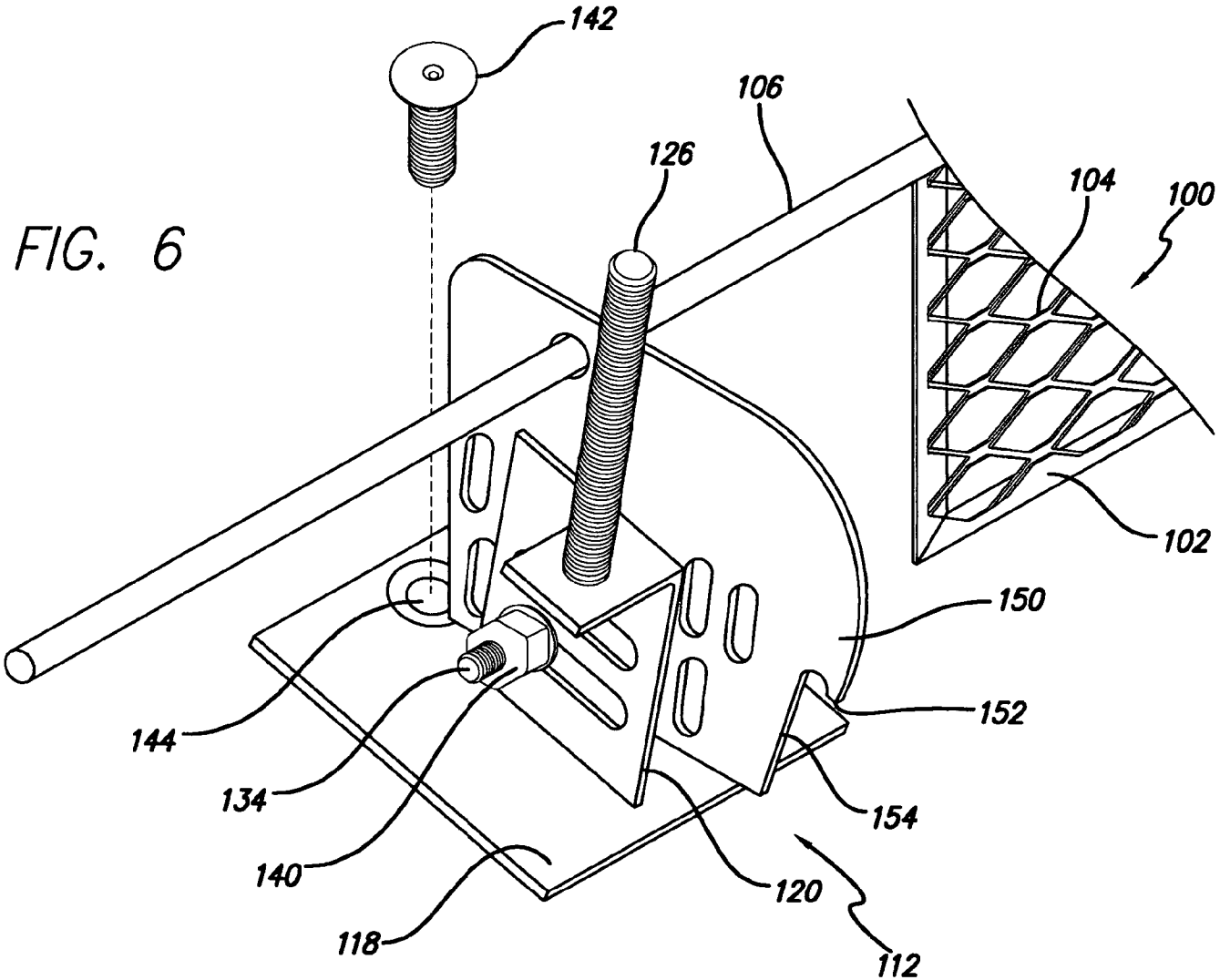
FIG. 6 is similar to FIG. 5, expect that the component pieces are shown assembled, with the exception that the lag bolt by which this bracket piece is attached to the drain basis is shown in exploded view.

The bracket assemblies 112 and 114 are designed and constructed to be attached to the horizontal portion 116 of the drain basin opening 12 (compare to the brackets 36 and 38 above, which are designed to be attached to the vertical interior wall of the basin). The bracket assemblies 112 and 114 are preferably mirror images of one another, and, as best seen in FIG. 5, (the following description also applies to each) bracket assembly 112 has a base 118 to which a flange 120 is attached, and extends perpendicularly above the base 118. In this preferred embodiment, flange 120 has an upper tab 122 that extends perpendicularly from the flange 120. The tab 122 has a threaded orifice 124 into which a threaded bolt 126 is screwed. Bolt 126 is used to secure the bracket within the curb opening 12 as, once the bracket assembly 112 is properly position within the curb opening 12, bolt 126 is screwed upward against the upper surface of the curb opening 12, thereby creating a tension fit. Flange 120 also has a pair of horizontally elongated attachment slots 128. The other main component of bracket assembly 112 is the adjustable guide 130. Adjustable guide 130 has a series of vertically elongated slots 132. Guide 130 is attached to flange 120 by conventional bolts 134, washers 136, lock washers 138, and nuts 140. The combination of the dual slots 128 and the multiple slots 132 allows for a large adjustment of the guide 130 to the flange 120. As best seen in FIG. 6, the bracket assembly 112 is preferable secured within the curb opening 12 by means of a set bolt 142 that extends through hole 144 and engages an anchor (not shown) that has been set into the concrete of the basin opening.

As best seen in FIG. 6, the rear (relative to the curb) portion of guide 130 is designed such that it has a rearwardly extending hook 150. It will be noted that detent 152 of the hook 150 extends downwardly a sufficient distance so that a pin (to be described below) will reside within the hook and will restrain the pin against force asserted against it in the rearward direction. Immediately below the detent 152, the rearward edge 154 of guide 130 slants forwardly, toward the curb.

Referring now to FIG. 4, the purpose of the guide 130, detent 152 and rearward edge 154 will be described. As seen in this Figure, attached to gate assembly 100 is a trip plate 160 that is attached to and extends from the rear portion of the gate portion 101 by means of hinges 162 and 164. Hinges 162 and 164 are preferably attached to the lower corners of gate portion 101, and can be attached by any conventional means, including welding, screws, or bolts, for example (not shown). Each of the hinges 162 and 164 have a hinge pin 166 and 168 that extend inwardly towards one another from the hinges 162 and 164. The hinge pins 166 and 168 communicate with appropriately sized holes 170 and 172 on the side arms 174 and 176 on trip plate 160 such that when so engaged, the trip plate 160 is securely held within, but is rotatable with respect to, the hinges 162 and 164, and hence to gate portion 101. As will be understood by those skilled in the art, circular springs 180 and 182 fits over hinge pins 166 and 168, and the extending spring coil legs 184 and 186 fit into properly sized holes 188 and 190 that are formed in the trip plate arm 176 and hinge 164 respectively so as to bias the trip plate 160 into an upward orientation. As will be appreciated by those skilled in the art, the biasing force can be pre-determined by selecting the size and number of coils within the springs 180 and 182.

The remainder of this embodiment of the trip plate 160 comprises a central trough 192 that extends between the sides arms 174 and 176. Also in this embodiment, the trip plate 160 has a pair of plates portions 194 and 196 that extend upwardly and rearwardly from the trough 192. It will be noted that the trough 192 in this embodiment does not extend at the way to the from of the side arms 174 and 176. Rather, there is a void area between the arms 174/176, the trough 192 and the gate 101.

The trip plate 160 also has a pair of pins 200 and 202 that extend laterally from the rear portion of the side arms 174 and 176. In this embodiment, each of the pins 180 and 182 are of two piece construction as shown. Various different constructions are of course possible. When the gate assembly 100 is fully assembled according to the attachment dotted lines in FIG. 4, it will be noted that when the trip plate 160 is in its closed (as shown in this embodiment, upward) position (as biased by the springs 180 and 182, the pins 200/202 will be forced upwardly within the detent 152 portion of hooks 150 in the two mirror image bracket assemblies 112/114. The detent portions 152 of the hooks 150 are each sized and shaped relative to the size of pins 200/202 such that when the pins 200/202 are in position within the detent 152 portion of hooks 150, the pins 200/202 cannot move in a rearward direction, such movement being retrained by the detent portions 152. As will be appreciated, this interaction between the pins 200/202 and detent portions 152 will hold the gate portion 101 into place in the closed position against the drain basin opening. As a low flow of water comes through the mesh material 104 of gate portion 101, the natural tendency of moving water to adhere to an adjacent surface will cause the water entering the drain basin opening 12 mainly to flow into the void space in front of the trip plate 160. As the water flow increases, however, some of the water will start to flow onto the trip plate 160 before cascading into the drain basis. As the water flow increases, the amount of water that is instantaneously acting against the trip plate 160 will also increase until the upward biasing force of the springs 180/182 is overcome. At that point, the rear portion trip plate 160 will start to move downwardly, rotating upon hinge pins 166/168. Once the rear portion of trip plate 160 has moved downwardly a sufficient amount, then pins 200/202 are freed from hooks 150. At that point, the pins 200/202 no longer act to hold the gate portion 101 in a closed position against the drain basin opening, and the pressure of water on gate portion 101 will swing it widely and immediately open. As it does, the gate portion 101 rotates on rod 106 into an open position against to top of the drain basin. Once the flow of water has receded, the gate 101 will drop back into place and the pines 200/202 will be brought back into position with the hooks 150.

As will be appreciated, the size and shape of the gate portion 101, the mesh material 104, the trip plate 160, the detent 150, and the strength of the biasing springs can be varied, so long as the resultant design works to open the gate portion 101 upon the desired flow of water. As will be appreciated, as the flow of water increases, more pressure is applied to the gate portion 101, which applies more pressure by pins 200/202 against the detent portions 152, so that will have to be taken into consideration. This is easily done by those skilled in the art. A representative embodiment is shown in FIG. 4, which is drawn generally to scale.

The final aspect of this embodiment includes side panels 206 and 208. These side panels 206/208 preferably have a similar frame and mesh material construction as gate 101, and are sized and shaped so as to fully occupy the remainder of the basin opening 12 on either side of the gate 101 (as best seen in FIG. 3). In this embodiment, the upper portion of the panels 206/208 are attached to a tubular member 210/212 which is sized and shaped so as to fit snugly onto rod 106. Once in place within the complete system, it will be seen that the backside of panels 206/208 rest against flanges 120 and are thus held into the closed position. As will also be appreciated, where this overall system is to be installed on a number of drain basin openings of varying widths, this embodiment can be utilized with a standard gate system 100 of common size, but with the ability to easily change the size of only three components in the overall system (that being the length of rod 106, and the width of side panels 206/208) in order to accommodate a wide variety of basin opening widths.

Lastly, in order to provide some protection to the rod 106, an L-bar 214 can be attached to the upper portion of the basin opening 12.

Although preferred embodiments have been shown and described, the disclosed invention and the protection afforded by this patent are not limited thereto, but are of the full scope of the following claims, and equivalents thereto.

The invention claimed is:

1. A gate system for attachment to a structure that has an opening through which fluid flows, the system comprising:

a) a gate assembly having a gate portion designed and constructed to allow fluid flow therethrough while preventing the passage of particulate matter of a predetermined size and shape, said gate portion rotatable between a closed position and an open position relative to said opening, and biased to said closed position;

b) at least one bracket assembly attached to said gate system on a side of said gate portion, said bracket assembly having at least one detent;

c) a trip plate rotatably attached to said gate assembly and rotatable between a closed position and an open position, and designed and constructed such that sufficiently large fluid flow through said gate portion flows at least in part against said trip plate, said trip plate being biased to said closed position;

d) said trip plate having at least one pin, said pin extending from said plate adjacent said bracket assembly;

e) said pin communicating with said detent in said bracket assembly to hold said gate portion in the closed position until fluid flow against said trip plate causes it to rotate out of communication with said detent, thereby allowing said gate portion to rotate into an open position away from said opening.

2. The invention of claim 1 wherein said pins extend substantially perpendicularly from the sides of said trip plate.

3. The invention of claim 2 wherein said pins extend laterally from said trip plate, substantially parallel to said gate portion.

4. The invention of claim 1 wherein there is only one pin extending from each side of said trip plate.

5. The invention of claim 1 wherein there is a plurality of pins extending from each side of said trip plate.

6. The invention of claim 5 wherein each of said plurality of pins extends substantially perpendicularly from each side of said trip plate.

7. The invention of claim 1 wherein there is only one detent in said bracket assembly.

8. The invention of claim 1 wherein there is a plurality of detents in said bracket assembly.

9. The invention of claim 1 wherein said bracket assemblies include at least one arcuate groove with which said at least one pin communicates.

10. The invention of claim 9 wherein at least one said detent is adjacent said arcuate groove.

11. The invention of claim 10 wherein at least one said detent is adjacent said arcuate groove, and said pin communicates with both said detent and said groove.

12. The invention of claim 11 wherein said trip plate is attached to said gate assembly substantially adjacent the bottom edge of said gate portion.

13. The invention of claim 12 wherein said trip plate is attached to said gate portion of said gate assembly.

14. The invention of claim 13 wherein at least a portion of said trip plate extends substantially perpendicularly from said gate portion.

15. The invention of claim 1 wherein said trip plate is attached to said gate assembly substantially adjacent the bottom edge of said gate portion.

16. The invention of claim 15 wherein said trip plate has two said pins, said pins extend one each from either side of said plate, and each respectively communicates with a detent in the adjacent said bracket assembly.

17. The invention of claim 1 wherein said trip plate has a size and shape that is less than the size and shape of said gate portion, and is biased to the closed position using springs.

18. The invention of claim 1 wherein said trip plate has a size and shape that is substantially the same as the size and shape of said gate portion, and is biased to the closed position using springs.

19. The invention of claim 1 wherein said trip plate has a size and shape that is larger than the size and shape of said gate portion, and is biased to the closed position using springs.

20. The invention of claim 1 wherein said structure is a storm system drain vault.

21. The invention of claim 1 wherein there are at least two said bracket assemblies, one on either side of said gate portion.

22. The invention of claim 1 wherein said gate assemblies are attached also attached to said structure.

23. The in invention of claim 1 wherein said at least on bracket assembly is attached only to said gate system.

24. The invention of claim 1 wherein said at least one bracket assembly is attached only to said structure.

* * * * *